United States Patent [19]

Allen et al.

[11] Patent Number: 4,872,909

[45] Date of Patent: Oct. 10, 1989

[54] PROCESS FOR ACID LEACHING OF MANGANESE OXIDE ORES AIDED BY HYDROGEN PEROXIDE

[75] Inventors: James P. Allen; Richard R. Corwin, both of Salt Lake City

[73] Assignee: The United States of America, as Represented by the Secretary of the Interior, Washington, D.C.

[21] Appl. No.: 229,408

[22] Filed: Aug. 8, 1988

[51] Int. Cl.[4] ..... C22B 3/00

[52] U.S. Cl. ..... 75/101 R; 75/2; 75/109; 75/111; 75/115; 423/51; 423/52; 423/55; 423/56; 423/57; 423/138; 423/140; 423/145; 423/146; 423/147; 423/150; 423/DIG. 4; 423/142

[58] Field of Search ..... 423/51, 52, 55, 56, 423/57, DIG. 4, 138, 140, 145, 146, 147, 150, 142; 75/2, 101 R, 109, 111, 115

[56] References Cited

U.S. PATENT DOCUMENTS

| | | | |
|---|---|---|---|
| 3,795,596 | 3/1974 | Kane et al. | 423/DIG. 4 |
| 3,810,971 | 5/1974 | Skarbo et al. | 423/DIG. 4 |
| 3,906,075 | 9/1975 | Menz | 423/DIG. 4 |
| 3,923,615 | 12/1975 | Kane et al. | 75/115 |
| 3,930,974 | 1/1976 | Kane et al. | 423/DIG. 4 |

OTHER PUBLICATIONS

Journal of Mines, vol. 28, No. 4, Apr. 1976, "Processing of Ocean Nodules: A Technical and Economic Review".

Department of the Interior Bulletin 226, 1925, "The Treatment of Manganese-Silver Ores", Clevenger et al., pp. 33–34.

*Primary Examiner*—Robert L. Stoll
*Assistant Examiner*—Paige C. Harvey
*Attorney, Agent, or Firm*—E. P. Koltos

[57] ABSTRACT

A method of processing manganese ore by adding the ore to an aqueous solution of acid and $H_2O_2$ to form a leach pulp. The leach pulp is agitated for a predetermined time period at predetermined temperatures. The leach pulp is then separated into a solid fraction and a liquid fraction containing solubilized metals. The solubilized metals are then recovered from the liquid fraction.

7 Claims, No Drawings

PROCESS FOR ACID LEACHING OF MANGANESE OXIDE ORES AIDED BY HYDROGEN PEROXIDE

ECHNICAL FIELD

This invention relates to a chemical process for leaching of manganese oxide, and more particularly to a process for acid leaching of manganese oxide ores aided by hydrogen peroxide.

BACKGROUND ART

There is little prior art for processing of low-grade manganese and related ores. Although several methods have been proposed, there are no proven processes for treatment of manganese nodules or cobalt-manganese crusts.

Acid leaching methods that have been proposed require either very long reaction time or the use of high temperature and pressure. A sulfur dioxide leaching system has been mentioned, but the process produces a solution that is not amenable to subsequent recovery of metals by known methods.

High temperature pyrometallurgical methods are undesirable because of the expense of water removal prior to processing. This drying operation will be very expensive for manganese nodules and crusts, which often contain 30 to 40 weight percent moisture.

Those concerned with these and other problems recognize the need for an improved process for leaching of manganese oxide ores.

DISCLOSURE OF THE INVENTION

The present invention provides a method of processing manganese ore by adding the ore to an aqueous solution of acid and $H_2O_2$ to form a leach pulp. The leach pulp is agitated for a predetermined time period at predetermined temperatures. The leach pulp is then separated into a solid fraction and a liquid fraction containing solubilized metals. The solubilized metals are then recovered from the liquid fraction.

The invention will be useful for developing manganese oxide ores, particularly marine manganese nodules and cobalt-manganese crusts.

The invention is a hydrometallurgical treatment suitable for extracting manganese from the ores.

The main application of the present invention will be for the hydro-metallurgical treatment of low grade manganese ores and manganese-bearing cobalt ores from the Exclusive Economic Zone of the United States. The process will recover manganese, cobalt, and nickel from the ore and reject major contaminants, such as iron.

$MnO_2$ is not soluble in acid, but a reduced form equivalent to MnO is soluble. In some cases, hydrogen peroxide $H_2O_2$, usually an oxidant, will reduce certain metal oxides and strong oxidizing agents, including $MnO_2$. Also, the decomposition of $H_2O_2$ is catalyzed by $MnO_2$. These observations led to the development of the present invention of a process for peroxide-aided acid leaching of manganese crust.

An object of the present invention is the provision of an improved process for acid leaching of manganese oxide ores.

Another object of the present invention is to provide a leaching process that proceeds much more rapidly than other processes.

A further object of the present invention is the provision of a process where no heating of the ore or leach pulp is required.

Still another object of the present invention is to provide a process where the products of reaction ($H_2O$, $O_2$) are innocuous.

A still further object of the present invention is the provision of a process where the enclosure of the leaching vessel is not required.

Yet another object of the present invention is the provision of a process where the solutions used and produced are dilute in acid, requiring less corrosion-resistant materials of construction.

Yet a further object of the present invention is the provision of a process where the metal-rich leach solution will lend itself with little additional treatment to solution concentration and purification.

These and other attributes of the invention will become more clear upon a thorough study of the following description of the best mode for carrying out the invention, particularly when reviewed in conjunction with the examples.

BEST MODE FOR CARRYING OUT THE INVENTION

The following examples are illustrative of the best mode for carrying out the invention. They are obviously not to be construed as limitative of the invention since various other embodiments can readily be evolved in view of the teachings provided herein.

The embodiment of the invention comprises all situations where manganese, cobalt-manganese, or related ores are combined with aqueous solutions of acid and hydrogen peroxide for the purpose of winning the metals from the ore.

The theory of the invention involves use of hydrogen peroxide ($H_2O_2$), normally an oxidant, as a reducing agent to render manganese dioxide soluble in acid solution. With sulfuric acid, the reaction is $$MnO_2+H_2O_2+H_2SO_4 \rightarrow MnSO_4+2H_2O+O_2$$

The leaching reaction can be thought of as interruption of the catalytic cycle in the decomposition of $H_2O_2$ catalyzed by $MnO_2$, with consumption of the catalyst. The first step of the cycle can be represented as reduction of the catalyst by peroxide.

$$H_2O_2+MnO_2 \rightarrow MnO+H_2O+O_2$$

In the second step, the catalyst is regenerated by reaction with additional peroxide $$MnO+H_2O_2 \rightarrow MnO_2+H_2O$$

By addition of acid, the regeneration of the catalyst is prevented because MnO dissolves readily in acid solutions, and leaching is accomplished in this manner. With ores such as manganese nodules and cobalt-manganese crust where cobalt, nickel, and other metals are intimately associated with the $MnO_2$, these metals are rendered soluble at the same time. Because low acid concentrations are required, if iron is solubilized it does not remain in solution, and the process demonstrates considerable selectivity against iron in favor of manganese, cobalt, and nickel.

Leaching is accomplished by adding the ore to be treated to a water solution of $H_2SO_4$ and $H_2O_2$ in an agitated vessel. Seawater may be used in place of water and HCl may be used in place of $H_2SO_4$.

The preferred temperature for leaching is room temperature. The process can be operated throughout the liquid range of water, 0° to 100° C. Some decrease in reagent consumption is possible at temperatures lower than 25° C.

Pulp densities up to 40 weight percent solids can be employed, depending on the feed material. For Pacific cobalt-manganese crust, the preferred pulp density range is 10 to 25 percent solids.

A relatively dilute solution of sulfuric acid and hydrogen peroxide is employed. For the crust mentioned, 0.43 pounds $H_2SO_4$ and 0.09 pounds $H_2O_2$ are required per pound of crust. Higher acid dosages than this result in excessive iron contamination of the leachate.

EXAMPLE 1

A 30 gram sample of minus 10-mesh cobalt-manganese crust was mixed with 200 mL of a water solution containing 3.4 weight percent $H_2SO_4$ and 1.2 weight percent $H_2O_2$ at room temperature. The crust, obtained from the ocean floor of the U.S. Exclusive Economic Zone (EEZ) in the Central Pacific Basin, assayed 6.07 percent Mn, 11.3 percent Fe, 0.19 percent Co, and 0.14 percent Ni. After 1 hour of agitation, the pulp was filtered and the filter cake was washed with fresh water. The combined filtrate and wash assayed 0.84 grams per liter Mn, 0.42 grams per liter Fe, 0.037 grams per liter Co, and 0.015 grams per liter Ni. Distribution to the filtrate, in percent, was 95 percent Mn, 28 percent Fe, 96 percent Co, and 90 percent Ni. This test was repreated using a synthetic seawater solution in place of water with similar results.

EXAMPLE 2

A 69.44 gram sample of a similar material obtained from the Johnston Island area of the Pacific Exclusive Economic Zone was leached in a solution containing 8.4 weight percent $H_2SO_4$ and 1.7 weight percent $H_2O_2$ at room temperature. After 1 hour of agitation, the pulp was filtered and the filter cake was washed with fresh water. The combined filtrate and wash assayed 8.0 grams per liter Mn, 3.7 grams per liter Fe, 0.31 grams per liter Co, and 0.18 grams per liter Ni. Distribution to the filtrate, in percent, was 90 percent Mn, 28 percent Fe, 90 percent Co, and 89 percent Ni.

EXAMPLE 3

A third example is a three-stage cross-current leach of a minus 100-mesh flotation concentrate of the material mentioned in Example 1. The concentrate assayed 9.49 percent Mn, 12.0 percent Fe, 0.36 percent Co, and 0.20 percent Ni. In each stage, 30 grams of fresh concentrate were added to the filtrate from the previous test plus concentrated $H_2SO_4$ and 30 percent $H_2O_2$ to make a solution containing 6.6 percent $H_2SO_4$ and 1.5 percent $H_2O_2$ with 13 percent solids. The leach was kept for 30 minutes at room temperature. Water was used in place of leach liquor in the first stage. The filtrate (exclusive of wash water) from the third stage assayed 34.0 grams per liter Mn, 3.0 grams per liter Fe, 1.4 grams per liter Co, and 0.64 grams per liter Ni. Leach recovery, in percent, was 95 percent Mn, 6 percent Fe, 98 percent Co, and 95 percent Ni.

EXAMPLE 4

10 grams of the concentrate mentioned in Example 3 were added to 1,000 mL of a solution containing 3.4 percent $H_2SO_4$ and 1.2 percent $H_2O_2$ by weight. (Although these are the same reagent concentrations used above, the low pulp density makes a large excess of reagent available). After 30 sec., 99 percent of the Mn and Co, 98 percent of the Ni, and 77 percent of the Fe had been leached. Large Fe recovery is observed when an excess of acid is used.

EXAMPLE 5

In two tests, 100 grams of the concentrate mentioned in Example 3 were added to solutions of 14.1 weight percent $H_2SO_4$ at 10 percent solids. To the first of these was also added hydrogen peroxide at 1.4 weight percent. After 60 minutes, both test were sampled. The first test had leached, in percent, 98 percent Mn, 64 percent Fe (illustrating the effect of excess acid), 98 percent Co, and 95 percent Ni. The second test (without peroxide) had leached, in percent, 17 percent Mn, 32 percent Fe, 15 percent Co, and 48 percent Ni. After a second hour, recoveries of Mn, Fe, Co, and Ni in the second test had only increased to 19, 41, 16 and 56, respectively. This demonstrates that rapid leaching is made possible by the presence of peroxide.

Hydrochloric acid can be used in place of sulfuric acid. Leaching times, temperatures, pulp densities, etc., are not changed by this.

EXAMPLE 6

30 grams of the 10-mesh crust described in Example 1 were added to 200 mL of a solution containing 3.1 percent HCl and 1.2 percent $H_2O_2$, by weight. After 1 hour of agitation at room temperature, the pulp was filtered and the residue was washed with water. The filtrate combined with the wash water assayed, in grams per liter, 7.5 grams per liter Mn, 0.18 grams per liter Fe, 0.33 grams per liter Co, and 0.19 grams per liter Ni. Leaching recoveries for Mn, Fe, Co, and Ni were 79 percent, 1 percent, 81 percent, and 80 percent, respectively.

Deep sea manganese nodules may also be leached with this process, as may any other manganese oxide ore.

EXAMPLE 7

30 grams of $MnO_2$ were added to 500 mL of a solution containing 7.7 weight percent $H_2SO_4$ and 2.3 weight percent $H_2O_2$. The entire sample dissolved within a few minutes, producing a leach solution assaying 57 grams per liter Mn. This illustrates the applicability of the process to ores having manganese oxide mineralogy.

While only certain preferred embodiment of this invention have been shown and described by way of illustration, many modifications will occur to those skilled in the art and it is, therefore, desired that it be understood that it is intended herein to cover all such modifications that fall within the true spirit and scope of this invention.

We claim:

1. A method of processing manganese ore, containing manganese, nickel, and cobalt metals comprising the steps of:

adding the manganese ore to an aqueous solution of acid and $H_2O_2$ to form a leach pulp wherein said leach pulp contains up to about 40 weight percent solids, about 20 weight percent acid, and about 10 weight percent $H_2O_2$;

agitating said leach pulp for up to about 1 hour period at a temperature of about 0° C. to 100° C.;

separating the leach pulp into a solid fraction and a liquid fraction containing manganese, nickel, and cobalt solubilitized metals; and recovering the solubilized manganese, nickel, and cobalt metals from the liquid fraction.

2. The method of claim 1 wherein said manganese ore is marine manganese nodules.

3. The method of claim 1 wherein said manganese ore is cobalt-manganese crusts.

4. The method of claim 1 wherein said acid is $H_2SO_4$.

5. The method of claim 1 wherein said acid is HCl.

6. The method of claim 1 wherein said temperature is about 25° C.

7. The method of claim 1 wherein said separating step is carried out by filtration.

* * * * *